US007600270B2

(12) United States Patent
Drab

(10) Patent No.: US 7,600,270 B2
(45) Date of Patent: Oct. 13, 2009

(54) CAP WITH INTEGRATED GLOVE

(76) Inventor: Dennis Drab, 1855 Carolyn Dr., Chula Vista, CA (US) 91913

( * ) Notice: Subject to any disclaimer, the term of this patent is extended or adjusted under 35 U.S.C. 154(b) by 0 days.

(21) Appl. No.: 11/282,195

(22) Filed: Nov. 18, 2005

(65) Prior Publication Data

US 2007/0113321 A1 May 24, 2007

(51) Int. Cl.
*A42B 1/24* (2006.01)

(52) U.S. Cl. ..... 2/209.13; 2/160; 2/161.1; 2/209.12

(58) Field of Classification Search ..... 2/19, 2/195.1, 209.12, 161.1, 162, 170; D2/246; 446/27

See application file for complete search history.

(56) References Cited

U.S. PATENT DOCUMENTS

D285,141 S * 8/1986 Whisman ..... D2/866
4,628,543 A * 12/1986 Hunt ..... 2/19
4,768,232 A * 9/1988 Villalobos ..... 2/19
4,829,600 A * 5/1989 Courtney ..... 2/19
4,868,927 A * 9/1989 Bourdeau et al. ..... 2/161.1
5,542,129 A 8/1996 Munoz
D404,541 S * 1/1999 Danza ..... D2/866
5,907,871 A 6/1999 Austin
5,920,913 A * 7/1999 Brandon et al. ..... 2/209.12
5,987,648 A * 11/1999 Boyd ..... 2/195.1
6,061,837 A 5/2000 Oh
6,158,054 A * 12/2000 Perry, Sr. ..... 2/195.1
D452,603 S 1/2002 Bunner, Jr.
6,457,183 B1 * 10/2002 Perry, Sr. ..... 2/209.12

* cited by examiner

*Primary Examiner*—Gary L Welch
*Assistant Examiner*—Sally Colson Cline
(74) *Attorney, Agent, or Firm*—Knobbe, Martens, Olson & Bear LLP

(57) ABSTRACT

Embodiments of a cap configured for catching a ball are disclosed. The cap comprises a brim affixed to a concave crown, and a glove portion affixed or integrated into the crown, wherein the glove portion comprises at least one opening proximate a wearer's ear for entry and accommodation of the wearer's hand. Certain embodiments of the cap further comprise an extension portion of the crown configured to unfold or extend to facilitate catching a ball.

16 Claims, 5 Drawing Sheets

CAP WITH INTEGRATED GLOVE

BACKGROUND OF THE INVENTION

1. Field of the Invention

The invention relates generally to a hat or cap, and more particularly to a cap configured for catching a ball.

2. Description of the Related Art

Baseball caps are worn by spectators at baseball games to shield the user from the sun and show support for a favorite team. Some of these spectators also bring baseball gloves to a game with the hope of catching a baseball hit into the stands. However, baseball gloves are bulky and cumbersome to wear when not in use, and once removed may not be easy to locate and assume in time to catch a quickly approaching ball. Thus, a baseball cap adapted for catching a ball would be useful for such a spectator, where the cap remains easily accessible during the game on the wearer's head.

Baseball caps for catching a ball are known in the art with various locations or entry points for a wearer's catching hand. However, the caps currently in the art do not allow for convenient and optimal hand entry or positioning for assuming the cap on a wearer's hand to catch a ball. Thus, an improved baseball cap configured for catching a ball is needed in the art.

SUMMARY OF THE INVENTION

Embodiments of the invention include a cap/glove combination, comprising a concave crown having an exterior surface, and a glove portion on the crown. The crown may have a top, a bottom, a front portion, a back portion, and two lateral portions. The glove portion comprises material affixed to the exterior surface of one of the lateral portions of the crown and forming at least one opening proximate a wearer's ear for entry and accommodation of a hand, where the glove portion extends from the opening over the lateral portion of the crown towards the top of the crown.

In some embodiments, the at least one opening comprises a hand entry opening for entry of a hand, and finger exit openings for exit of the distal ends of fingers, where the hand entry opening faces toward the bottom of the lateral portion of the crown. In some embodiments, the hand entry opening is substantially larger than each of the finger exit openings. The cap/glove combination may further comprise padding on an interior surface of the crown proximate the glove portion, and the glove portion may comprise a stretchable material, for example.

In certain embodiments, the crown further comprises an extension portion of material proximate a thumb accommodating portion of the glove portion, wherein the extension portion of material is extended by engagement of the thumb accommodating portion. In some embodiments, the extension portion may be folded in an unextended state when the glove portion is not engaged by a hand. The cap/glove combination may also comprise an affixing mechanism attached to the extension portion to maintain the extension portion in an unextended state when the affixing mechanism is engaged, and the affixing mechanism may comprise a hook and loop fastener such as VELCRO, for example.

In some embodiments, the glove portion comprises a semi-rigid material proximate the hand entry opening and configured to maintain the opening in a substantially open state. The cap/glove combination may further comprise an additional glove portion opposite the first glove portion and proximate a wearer's ear on the crown, comprising material affixed to the crown and forming at least one opening for entry and accommodation of a hand. In certain embodiments, the cap/glove combination further comprises a brim fixed to the crown and extending from the front portion of the crown.

In yet another embodiment, a cap configured to accommodate a wearer's hand to facilitate catching a ball comprises a concave crown comprising an exterior surface, and at least one hand accommodating portion comprising one or more materials fixed to the exterior surface of the crown proximate a wearer's ear. The crown may have a top, a bottom, a front portion, a back portion, and two lateral portions. In some embodiments, the at least one hand accommodating portion comprises a hand entry opening for entry of a hand, and finger exit openings for exit of the distal ends of one or more fingers, where the hand entry opening faces toward the bottom of the lateral portion of the crown. In some embodiments, the hand entry opening is substantially larger than the finger exit openings. In some embodiments, the hand accommodating portion permits entry of a wearer's hand moving over the lateral portion of the crown from the bottom of the lateral portion toward the top of the crown.

The cap may further comprise padding on an interior surface of the crown proximate the hand accommodating portion, and the hand accommodating portion may comprise a semi-rigid material proximate a hand entry opening so as to maintain the opening in a substantially open state.

In some embodiments, the crown further comprises an extension portion of material proximate a thumb accommodating portion of the hand accommodating portion, wherein the extension portion of material is extended by engagement of the thumb accommodating portion. The extension portion may be folded in an unextended state when the glove portion is not engaged by a hand, and the cap may further comprise an affixing mechanism attached to said extension portion to maintain said extension portion in an unextended state when said affixing mechanism is engaged.

DETAILED DESCRIPTION OF THE PREFERRED EMBODIMENT

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
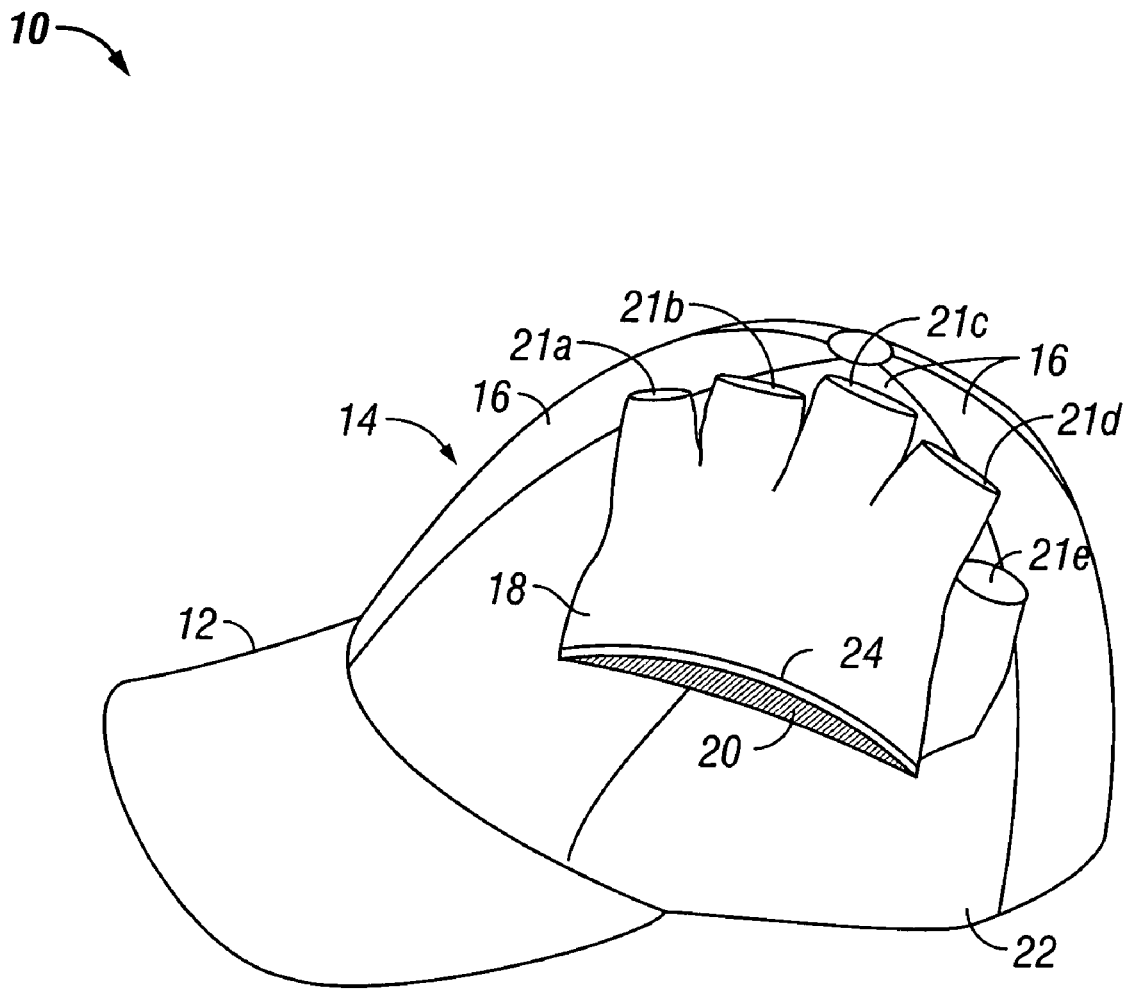
FIG. 1 is a perspective view of one embodiment of a cap configured to facilitate catching a ball.

One embodiment of a cap 10 configured for catching a ball is illustrated in FIG. 1, wherein the cap 10 comprises a semi-rigid brim or visor 12 affixed to a concave crown 14. The crown 14 may comprise a plurality of panels 16 assembled to form a desirable shape for a wearer's head. The cap 10 further comprises a glove or hand accommodating portion 18 affixed or integrated into the crown 14, wherein the glove portion 18 comprises at least one opening 20 proximate a wearer's ear for entry and accommodation of the wearer's hand. In one embodiment, the glove portion comprises one or more materials affixed to an exterior surface 22 of the crown 14 and forming the opening 20.

In one embodiment, the glove portion 18 comprises a semi-rigid material proximate the hand entry opening 20 and configured to maintain the glove portion 18 in a substantially open state for ease of entry of a hand. For example, the glove portion 18 may include a plastic portion 24 attached to or integrated into the glove portion 18 proximate the hand entry opening 20, wherein the plastic portion 24 has a semi-circular shape so as to maintain the opening 20 in a substantially open state for entry of a hand.

In some embodiments, the glove portion 18 comprises a unitary glove structure configured to accommodate a wearer's hand independent of the exterior surface 22 of the crown 14. Such a glove portion 18 may be affixed to the exterior surface 22 of the crown 14 by any suitable means, such as sewing, gluing, snaps, buttons, or rivets.

In one embodiment, the glove portion 18 comprises one or more pieces of material configured to accommodate a wearer's hand in conjunction with the exterior surface 22 of the crown 14. The one or more pieces of material may be affixed to the exterior surface 22 of the crown 14 by sewing or gluing, for example, or by an affixing mechanism, such as snaps, buttons, or rivets. As will be appreciated by those skilled in the art, there are a plurality of methods and means for affixing the glove portion to the crown and the invention is not limited to those listed herein.

In certain embodiments, the cap 10 comprises two glove portions, wherein a first glove portion is affixed to the crown 14 proximate a wearer's first ear, and a second glove portion is affixed to the crown proximate a wearer's second ear. Thus, a wearer can insert either their left or right hand into a glove portion, and such a cap can be used by a left-handed or right-handed person. In still other embodiments, the glove portion 18 may be removable from a first location on the crown 14 proximate a wearer's first ear, and affixable to a second location on the crown 14 proximate a wearer's second ear. Furthermore, the location of the glove portion, or elements thereof, such as finger accommodating portions, may be adjustable.

Figure 2:
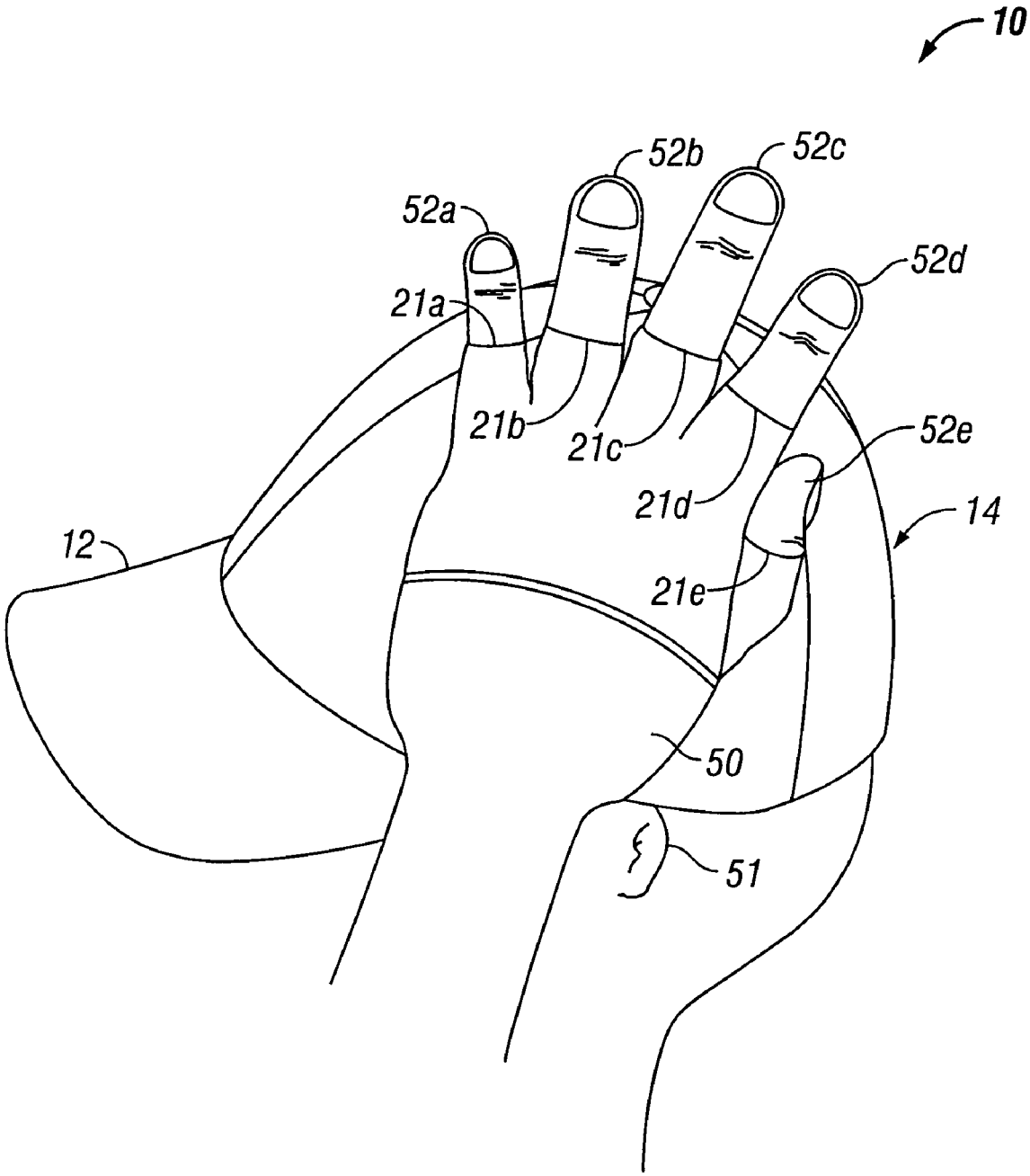
FIG. 2 is a perspective view of the cap of FIG. 1 on a wearer's head and with a glove portion engaged by the wearer's hand.

In certain embodiments, the glove portion 18 comprises the hand entry opening 20 for entry of a hand, and finger exit openings 21*a-e* for exit of the distal ends of fingers. The accommodation of a wearer's hand by the glove portion 18 is illustrated in the perspective illustration of FIG. 2, wherein the glove portion 18 is engaged by a wearer's hand 50 proximate the wearer's ear 51. As illustrated in FIG. 2, the distal ends 52*a-e* of the wearer's hand exit the glove portion 18 at finger exit openings 21*a-e* such that they are not constricted by the glove portion 18. Thereby, a cap with a single size or limited adjustment can be used by a plurality of individuals with different sized hands without constriction.

Alternately, the glove portion 18 may comprise material for accommodating substantially the entirety of one or more of a wearer's fingers. The glove portion 18 may comprise a stretchable material, or a combination of materials having different stretching capacities, and may include, for example, a mesh material or a spandex material such as LYCRA. In some embodiments, the glove portion 18 comprises an adjustment mechanism, such as two pieces of material configured to be latched, coupled, tied, or fastened together at different lengths. For example, the adjustment mechanism may comprise two pieces of material configured with an affixing mechanism such as a hook and loop fastener, such as VELCRO. The glove portion 18 may also comprise openings to allow for ease of movement or accommodation of different sized hands, such as one or more opening proximate a wearer's knuckles.

Figure 3:
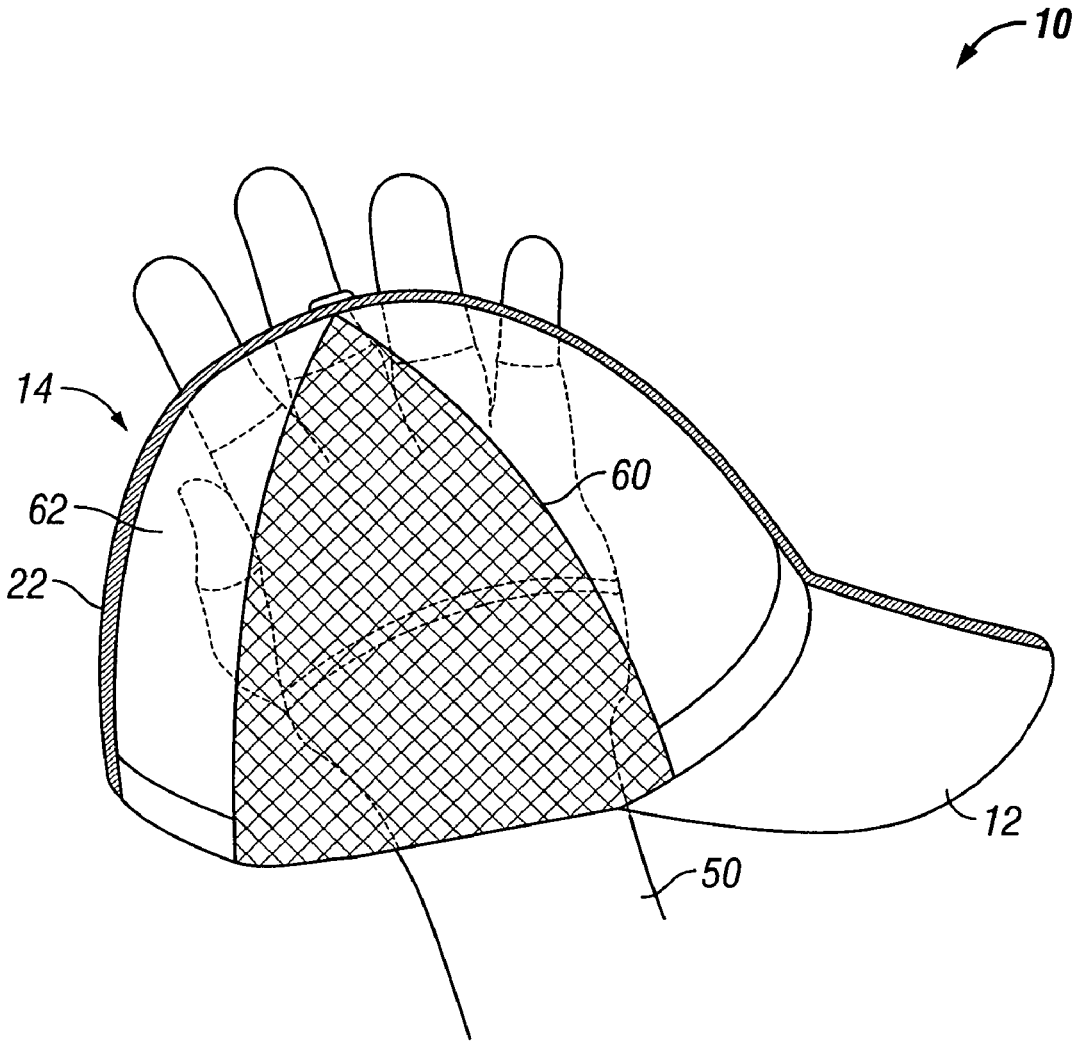
FIG. 3 is a cross-sectional view of the cap of FIG. 2, illustrating the interior of the cap with padding.

FIG. 3 is a cross-sectional view of the cap 10 with the glove portion 18 engaged by a wearer's hand 50. As illustrated in the embodiment of FIG. 3, the cap 10 comprises padding 60 affixed or integrated into an interior surface 62 of the crown 14 proximate the glove portion 18 (indicated by the wearer's hand 50 but not shown in FIG. 3). The padding 60 may comprise one or more pieces of material affixed or integrated into one or more of the panels 16 shown in FIG. 1, or the padding 60 may be affixed across a plurality of panels or the interior surface 62 of the crown 14. The padding 60 may comprise one or more materials, including multiple layers of materials such as foam. The padding 60 may have a geometry corresponding to one or more of the panels 16 of the crown 14, a semi-circular geometry, or other geometries appropriate for protecting a wearer's hand from the impact experienced when catching a ball.

Figure 4:
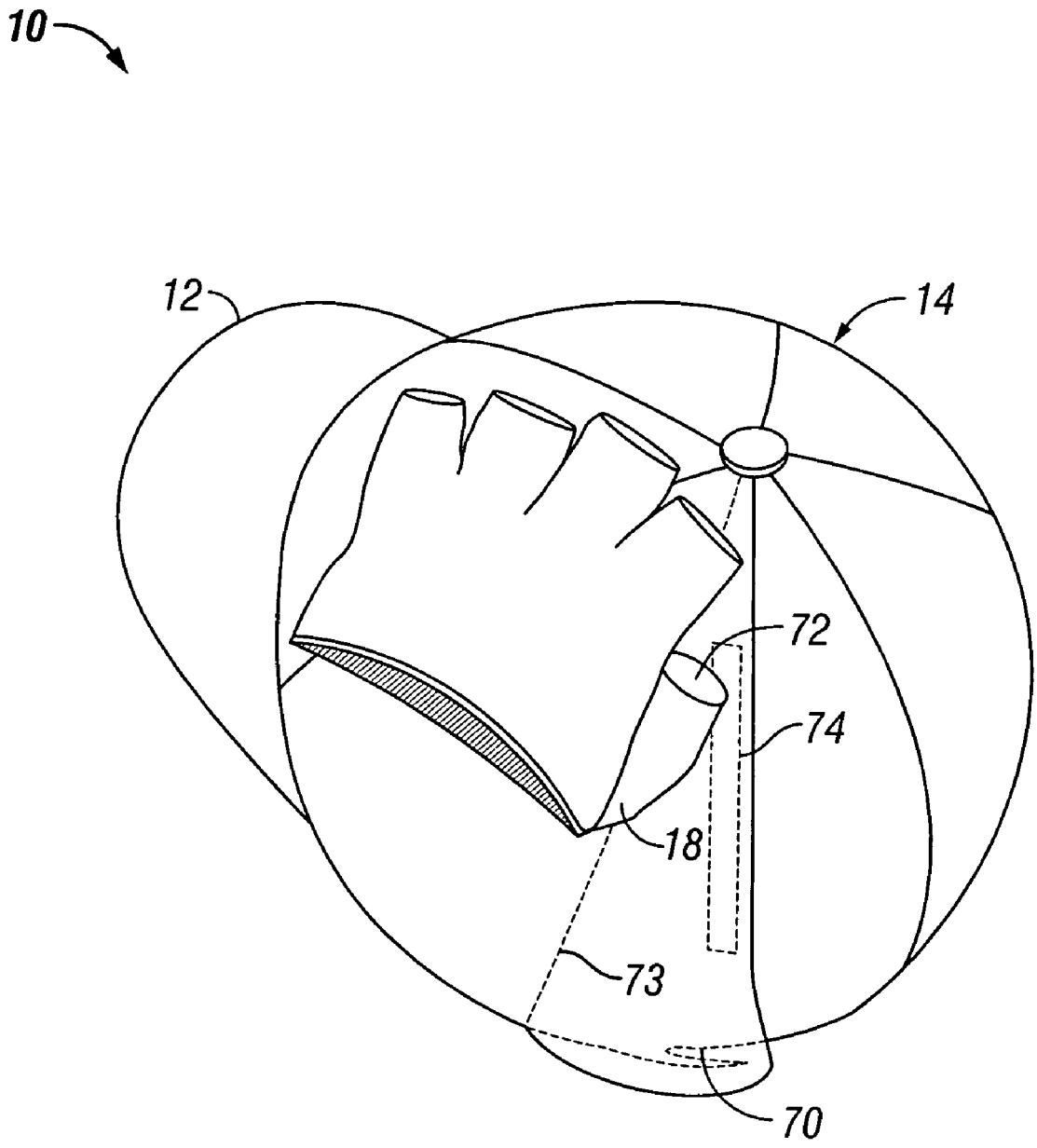
FIG. 4 is a perspective view of one embodiment of a cap configured to facilitate catching a ball and including an extension portion folded in an unextended state.

FIG. 4 is a perspective view of one embodiment of the cap 10 wherein the crown 14 further comprises an extension panel or portion 70 proximate a thumb accommodating portion 72 of the glove portion 18. The extension portion 70 comprises a piece of material folded (dashed line 73) in an unextended state as shown in FIG. 4, and may be maintained in the unextended state by an affixing mechanism 74. In one embodiment, the affixing mechanism 74 comprises a hook and loop fastener such as VELCRO attached to the folded area of the extension portion 70. The affixing mechanism 74 may comprise other affixing means, such as snaps or buttons. In one embodiment, the affixing mechanism 74 comprises one or more elastic pieces configured to retain the extension portion 70 in an unextended state when the one or more elastic pieces are in a resting or unstretched state.

Figure 5:
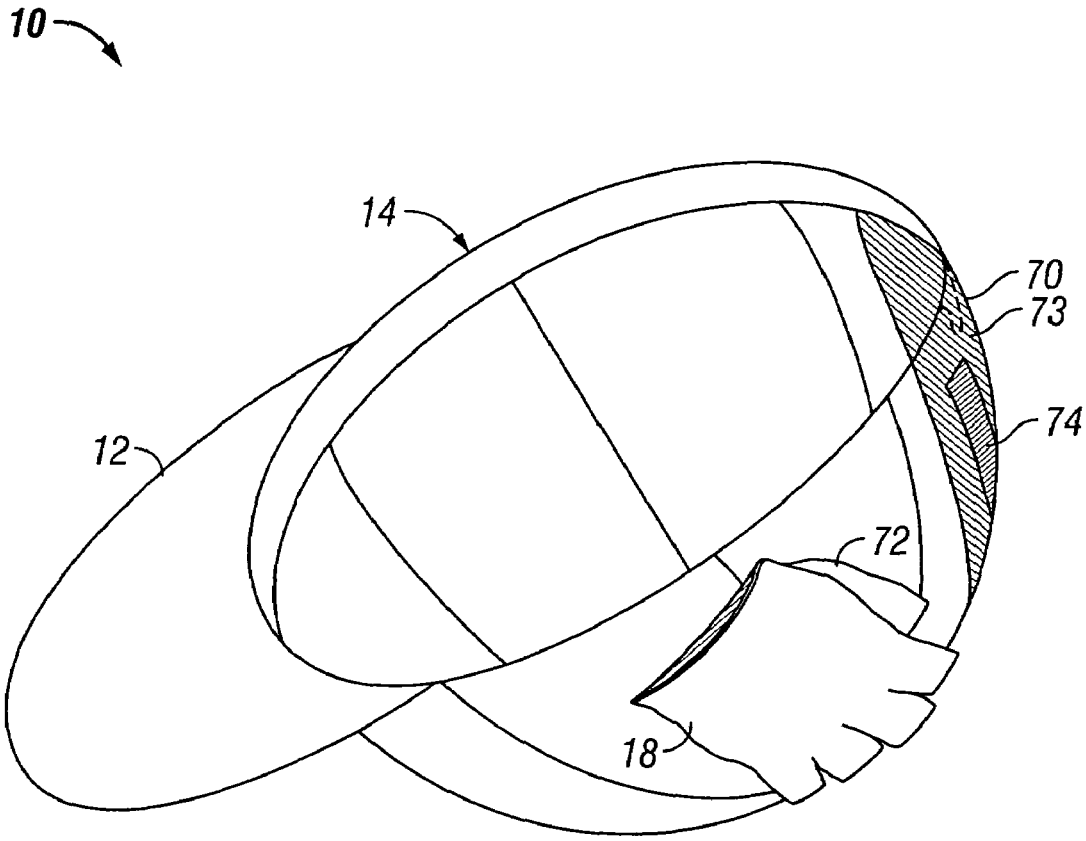
FIG. 5 is a perspective view of the cap of FIG. 4 with the extension portion in an extended state.

As illustrated in FIG. 5, the extension portion 70 provides additional circumference and surface area to the crown 14 in an unfolded or extended state for catching a ball. In one embodiment, the extension portion 70 is extended by engagement of a thumb accommodating portion 72 of the glove portion 18 by a wearer's hand. In such an embodiment, the thumb accommodating portion 72 may comprise material for accommodating substantially the entire length of a wearer's thumb so as to further facilitate extension or unfolding of the extension portion 70. The extension portion 70 may comprise the same or similar material as the crown 14, or the extension portion 70 may comprise a thinner material than that of the crown 14 so as to reduce bulkiness when the extension portion 70 is in a folded or unextended state. In one embodiment, the extension portion 70 comprises a stretchable or resilient material, such as a mesh material, so as to further facilitate catching a ball.

As will be appreciated by those skilled in the art, the invention is not limited to the specific configuration of the cap described above or illustrated in the drawings. For example, the brim may extend around substantially the entire perimeter of the crown, and the crown may comprise a single panel of material, or panels of material in a configuration different from that illustrated. Furthermore, the materials of the glove portion and the extension portion may comprise materials, or combinations thereof, other than those listed above. In addition, the location of the extension portion is not limited to that illustrated and described. For example, the extension portion may be located between the thumb accommodating portion and an index finger accommodating portion, or the cap may comprise a plurality of extension portions between some or all of the finger accommodating portions.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A cap/glove combination, comprising:

a concave crown said crown having an exterior surface comprising a plurality of crown panels, said crown having a top, a bottom, a front portion, a back portion, and two lateral portions;

a brim fixed to said crown and extending from the front portion of said crown; and a glove portion on said crown, comprising material affixed to said exterior surface of one of the lateral portions of said crown, said glove portion having at least one facing toward the bottom of said one lateral portion of the crown, with said glove portion extending from said opening over said one lateral portion of the crown toward the top of the crown, wherein one of said crown panels has a dimension larger than other crown panels, and further comprises an extension portion of material proximate a thumb accommodating portion of said glove portion, wherein said extension portion of material is extended by engagement of the thumb accommodating portion to expand the surface area of the crown.

2. The cap/glove combination of claim 1, further comprising padding on an interior surface of said crown proximate said glove portion.

3. The cap/glove combination of claim 1, wherein said glove portion comprises a stretchable material.

4. The cap/glove combination of claim 1, wherein said extension portion is folded in an unextended state when said glove portion is not engaged by a hand.

5. The cap/glove combination of claim 1, further comprising an affixing mechanism attached to said extension portion to maintain said extension portion in an unextended state when said affixing mechanism is engaged.

6. The cap/glove combination of claim 5, wherein said affixing mechanism comprises a hook and loop fastener.

7. The cap/glove combination of claim 1, further comprising an additional glove portion opposite the first glove portion on said crown, comprising material affixed to the other lateral portion of said crown said additional glove portion having a hand entry opening for entry and accommodation of a hand and finger exit openings for exit of the distal ends of fingers, said hand entry opening facing toward the bottom of said other lateral portion of the crown, with the additional glove portion extending from said opening over said other lateral portion of the crown toward the top of the crown.

8. The cap/glove combination of claim 1, wherein said glove portion comprises a semi-rigid material proximate said opening and configured to maintain said opening in a substantially open shape.

9. A cap configured to accommodate a wearer's hand to facilitate catching a ball, the cap comprising:

a concave crown comprising an exterior surface, said crown having a top, a bottom, a front portion, a back portion, and two lateral portions;

a brim affixed to said crown and extending from the front portion of said crown; and at least one hand accommodating portion comprising one or more materials fixed to said exterior surface of one of the lateral portions of said crown, wherein said hand accommodating portion permits entry of a wearer's hand moving over said one of the lateral portions of said crown from the bottom of said one lateral portion toward the top of the crown, wherein said crown further comprises an extension portion of material proximate a thumb accommodating portion of said hand accommodating portion, wherein said extension portion of material is extended by engagement of said thumb accommodating portion.

10. The cap of claim 9, wherein said at least one hand accommodating portion comprises a hand entry opening for entry of a hand, and finger exit openings for exit of the distal ends of one or more fingers.

11. The cap of claim 9, further comprising padding on an interior surface of said crown proximate said hand accommodating portion.

12. The cap of claim 9, wherein said hand accommodating portion comprises a semi-rigid material proximate a hand entry opening so as to maintain said opening in a substantially open state.

13. The cap of claim 9, wherein said extension portion is folded in an unextended state when said glove portion is not engaged by a hand.

14. The cap of claim 9, further comprising an affixing mechanism attached to said extension portion to maintain said extension portion in an unextended state when said affixing mechanism is engaged.

15. The cap of claim 14, wherein said affixing mechanism comprises a hook and loop fastener.

16. A cap/glove combination, comprising:

a concave crown having an exterior surface, said crown having a top, a bottom, a front portion, a back portion, and two lateral portions;

a brim fixed to said crown and extending from the front portion of said crown;

a first glove portion on said crown, comprising material affixed to said exterior surface of one of the lateral portions of said crown, said first glove portion having a hand entry opening for entry and accommodation of a hand and finger exit openings for exit of the distal ends of fingers, wherein the hand entry opening is substantially larger than the finger exit openings, said hand entry opening facing toward the bottom of said one lateral portion of the crown, with said glove portion extending from said opening over said one lateral portion of the crown toward the top of the crown; and a second glove portion opposite the first glove portion on said crown, comprising material affixed to the other lateral portion of said crown, said second glove portion having a hand entry opening for entry and accommodation of a hand and finger exit openings for exit of the distal ends of fingers, said hand entry opening facing toward the bottom of said other lateral portion of the crown, with the second glove portion extending from said opening over said other lateral portion of the crown toward the top of the crown.

* * * * *